United States Patent [19]

MacTurk

[11] 3,985,851

[45] Oct. 12, 1976

[54] METHOD OF FORMING A FEED HORN

[75] Inventor: William L. MacTurk, Claremont, Calif.

[73] Assignee: General Dynamics Corporation, Pomona, Calif.

[22] Filed: June 24, 1974

[21] Appl. No.: 482,732

[52] U.S. Cl. ..... 264/104; 29/600; 29/601; 264/162; 264/220; 264/225; 264/227; 343/786

[51] Int. Cl.[2] ..... H01P 11/00

[58] Field of Search ..... 264/104, 219, 220, 227, 264/225, 162; 29/601, 600; 343/786

[56] References Cited

UNITED STATES PATENTS

| | | | |
|---|---|---|---|
| 2,761,137 | 8/1956 | Van Atta et al. | 333/95 |
| 2,826,524 | 3/1958 | Molloy | 264/317 |
| 3,320,341 | 5/1967 | Mackie | 264/104 |
| 3,339,275 | 9/1967 | Anderson et al. | 29/601 |
| 3,395,059 | 7/1968 | Butler et al. | 264/104 |
| 3,487,539 | 1/1970 | Dugan et al. | 29/600 |
| 3,853,590 | 12/1974 | Kadison et al. | 204/30 |

*Primary Examiner*—Jeffery R. Thurlow
*Attorney, Agent, or Firm*—Albert J. Miller; Edward B. Johnson

[57] ABSTRACT

A method of forming a plastic microwave feed horn by first forming a mandrel which is thereafter incorporated into a mold apparatus.

1 Claim, 10 Drawing Figures

METHOD OF FORMING A FEED HORN

BACKGROUND OF THE INVENTION

The increased reliance on multi-band, broad band, and higher frequency devices has introduced a complexity, sophistication and tightness of mechanical tolerances heretofor not required or even contemplated in guidance systems and componentry. Simultaneously, however, there has been a strong, but conflicting, demand for cost reduction and lighter weight components with greater production simplicity.

Microwave feed horns for high frequency propagation, both linear and exponential, are subject to these diverse demands. For many years, these horns were made from machined or cast metal with dip brazed or soldered flanges. A corrosion free finish was then plated on the unit. These metal units suffered from high weight and were very costly to build because of the stringent physical tolerances.

Attempts to produce a lighter weight laminated feed horn, exemplified in U.S. Pat. Nos. 2826524, 3320341 and 3339275, were largely ineffective. Thus there remains a pressing need for a low cost, lightweight microwave feed horn having improved reliability and batch production capability.

SUMMARY OF THE INVENTION

The invention is directed to a method of forming a microwave feed horn of a light weight, high strength plastic. A mandrel is formed and incorporated in mold apparatus to form the feed horn.

DETAILED DESCRIPTION OF THE PREFERRED EMBODIMENTS

Figure 1:
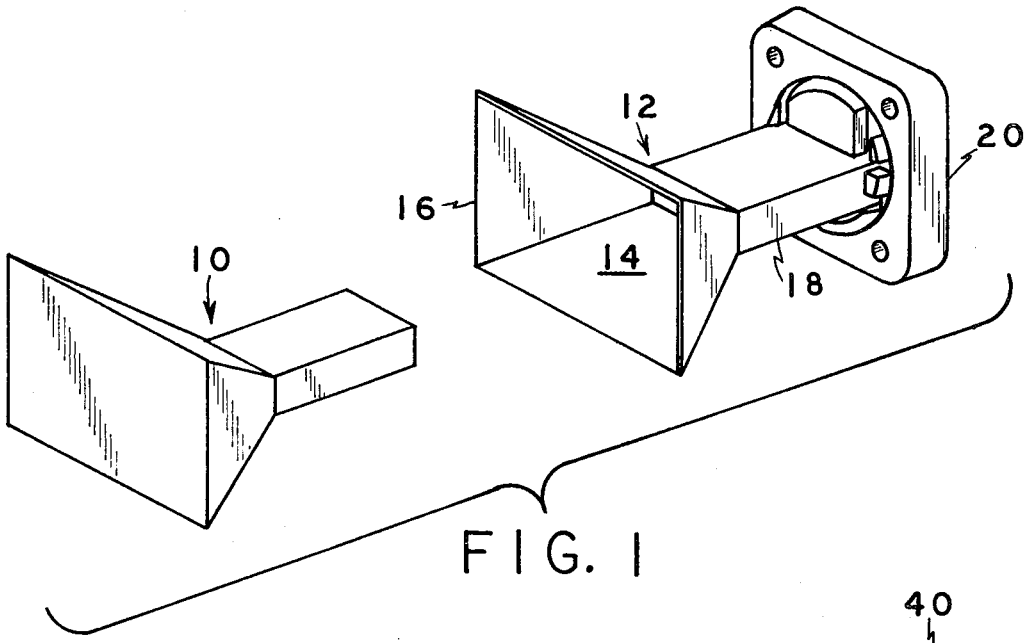
FIG. 1 is an exploded view of a metal microwave horn and a mandrel pattern formed therein.

As illustrated in FIG. 1, a mandrel pattern 10 is formed in the interior of a conventional metal feed horn 12. After a release agent, such as epoxy parfilm is spray coated on the interior surfaces 14 of the metal feed horn 12, the wide mouth or front end 16 of the horn 12 is sealed by placing the horn 12, wide mouth down, on any flat surface. A room temperature curing epoxy compound, such as Stycast 1090, is poured into the horn 12 through the open-ended base 18 with mounting flange 20. After a room temperature cure to prevent shrinkage of the epoxy plastic, the pattern 10 is removed from the metal feed horn 12 using a small arbor press.

Figure 2:
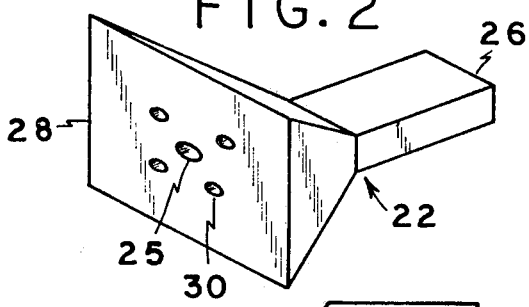
FIG. 2 is a perspective view of the mold mandrel formed from the mandrel pattern of FIG. 1.
Figure 5:
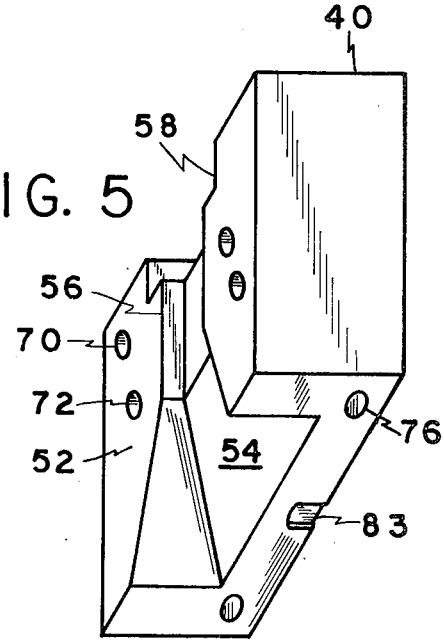
FIG. 5 is a bottom perspective view of the mold apparatus right side mold.
Figure 4:
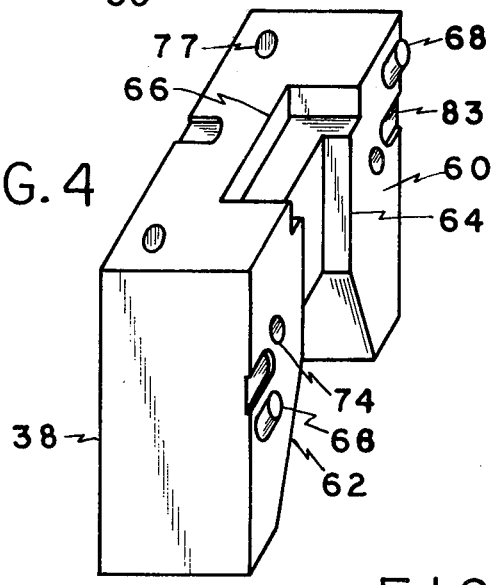
FIG. 4 is a top perspective view of the mold apparatus left side mold.
Figure 3:
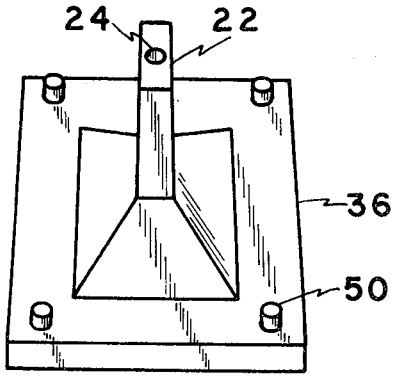
FIG. 3 is a top perspective view of the mold apparatus bottom plate and the mandrel of FIG. 2.
Figure 8:
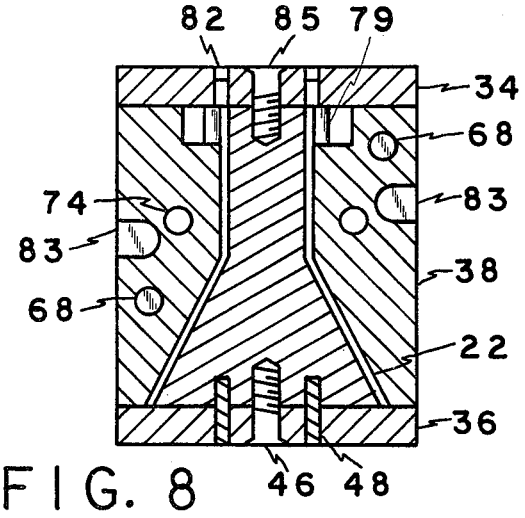
FIG. 8 is a cross-sectional view of the mold apparatus taken along line 8—8 of FIG. 7.
Figure 9:
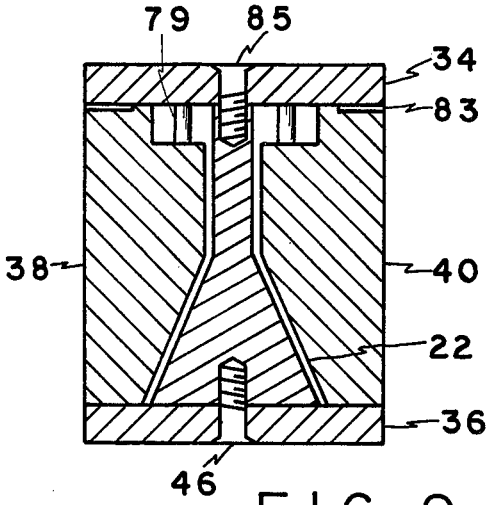
FIG. 9 is a cross-sectional view of the mold apparatus taken along line 9—9 of FIG. 7.
Figure 7:
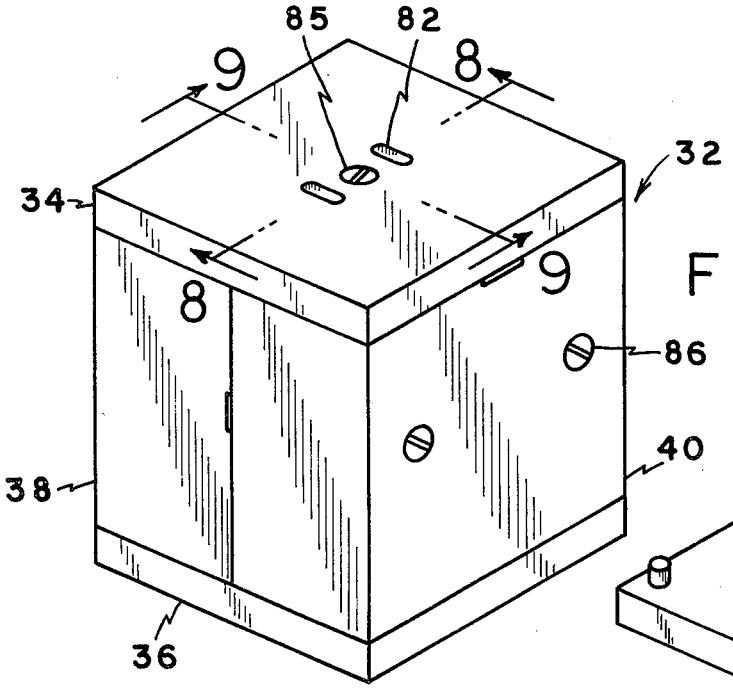
FIG. 7 is a perspective view of the assembled mold apparatus.
Figure 6:
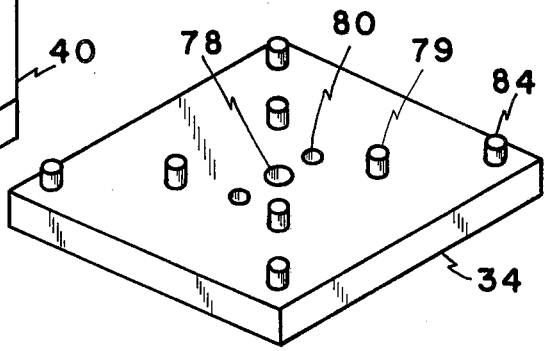
FIG. 6 is a bottom perspective view of the mold apparatus top plate.

The epoxy plastic pattern 10 is then used to form the FIG. 2 mandrel 22 of a metal such as aluminum. Any suitable machining process, such as a trace milling machine, can produce the aluminum mandrel 22 to the identical dimensions of the plastic pattern 10. A threaded hole 24 is drilled and tapped in the base end surface 26 while threaded hole 25 is tapped in the front end surface 28 of the mandrel 22, both at the center thereof. In addition, a plurality of smaller holes 30 are drilled around the tapped hole 25 in the front end surface 28.

The mold apparatus 32, including mandrel 22, is illustrated in FIGS. 3–9. Besides the mandrel 22, the mold apparatus 32 comprises a bottom plate 36, top plate 34, a left side mold 38 and a right side mold 40, all of a material such as tool steel.

The bottom mold plate 36, a generally square flat plate, includes a central hole aligned with the central threaded hole 25 in the front end surface 28 of the mandrel 22. The mandrel 22 is affixed to the bottom plate 36 by means of a bolt 46 extending through the bottom mold plate central hole into the mandrel front end central hole 25. A plurality of pins 48 extending from the bottom mold plate 36 into the mandrel front end holes 30 align the mandrel 22 on the bottom mold plate 36. At each corner of the bottom mold plate 36, there is disposed a projecting mounting pin 50.

The left and right side molds 38 and 40 are essentially identical except that they are reversed in position in the mold apparatus. Each is generally a rectangular solid having a recessed mold cavity on the front face thereof. The front face 52 of the right side mold 40 includes a tapered recessed section 54, an elongated central recessed section 56 and an enlarged upper recessed section 58 to form the mold cavity around the mandrel 22. The front face 60 of the left side mold 38 includes corresponding sections 62, 64, and 66 respectively.

Projecting outward from the front face 60 of the left side mold 38 are two mounting pins 68 aligned with two mounting pin holes 70 in the front face 52 of the right side mold 40. Likewise, threaded holes 74 in the left side mold 38 are aligned with bolt holes 72 in the right side mold 40. Mounting pin holes 76 are likewise drilled in the bottom surfaces of the left and right side molds 38 and 40. A plurality of pry slots 83 may be included on the mating faces of the left and right side molds 38 and 40 to facilitate disassembly of the mold apparatus 32.

The top mold plate 34 is generally square with the same dimensions as the bottom mold plate 36. It also includes a central hole 78 aligned with the central threaded hole 24 in the base end surface 26 of the mandrel 22. Two feed holes 80 having slotted recesses 82 at the top thereof extend through the top mold plate 34. The bottom of the top mold plate 34 includes mounting pins 84 to be aligned with mounting pin holes 77 in the top surfaces of left and right side molds 38 and 40. In addition, the top mold plate 34 also includes four equally spaced pins 79 which produce the flange holes 81 on plastic horn 90 of FIG. 10 during the injection molding step. The pins 79 seat in the recessed sections 58 and 66 of the mold cavity.

After the mandrel 22 has been affixed to the bottom mold plate 36 by means of bolt 46 and pins 48, the left side mold 38 is assembled to the right side mold 40. Mounting pins 68 from the left side mold 38 project into mounting pin holes 70 in the right side mold. Bolts 86 extend through holes 72 in right side mold 40 into threaded holes 74 in left side mold 38 to secure the two sides 38 and 40 together.

The assembled side molds 38 and 40 are then placed over the bottom mold plate 36 with bottom plate mounting pins 50 projecting into mounting pin holes 76 in the bottom of the sides plates 38 and 40. The top mold plate 34 is then placed over the side molds 38 and 40 with top plate mounting pins 84 inserted in mounting pin holes 77 in the top surface of the side molds 38 and 40. A bolt 85 extending through hole 78 in the top plate 34 is screwed into threaded hole 24 in the base surface of the mandrel 22.

The assembled mold apparatus 32 forms a mold cavity around the mandrel 22. The tapered front end of the feed horn is formed in the tapered recessed sections 54 and 62, the feed horn base is formed in the elongated recessed sections 56 and 64 and the feed horn flange is formed in the enlarged recessed sections 58 and 66. The assembled mold apparatus 32 is inserted in any conventional injection molding machine with the feed mechanism aligned with the recessed slots 82 of feed holes 80. Any thermoplastic material, such as Acrylonitrile Butadiene Styrene (ABS), may be injection molded into the mold cavity to produce the feed horn. Pelletized Lustran (trademark of Monsanto Chemical), a pelletized high impact, high strength platable grade plastic, has been found to be suitable. A time cycle of approximately 60 seconds can produce a feed horn at an injection pressure of 900 psig and a nozzle temperature of 375° F.

Figure 10:
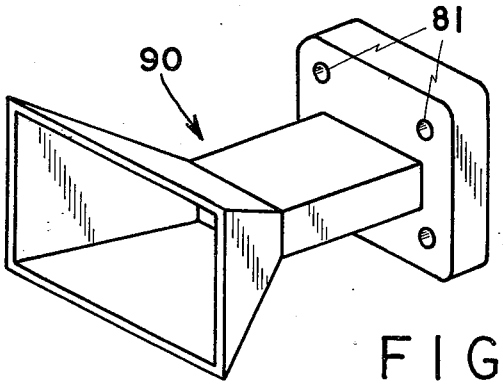
FIG. 10 is a perspective view of the feed horn produced in the mold apparatus of FIGS. 3–9.

After injection molding, the mold apparatus 32 is disassembled by means of a prying tool in the pry slots 83. The plastic feed horn 90, illustrated in FIG. 10, is then removed therefrom. It should be recognized that the size and shape of the feed horn can be made to fit its particular application. For example the horn can be molded without the flange if desired.

In order to prepare the plastic horn for plating, the feed horn 90 is sensitized by a wet vapor honing to remove the high gloss sheen therefrom. Electroless copper plating for approximately 1 hour followed by electrolytic copper plating for 20 minutes at a load current of 5 amperes will deposit a 1 mil copper plating on the feed horn. A $50 \times 10^{-6}$ gold plate is then electrodeposited over the copper plating to provide a corrosion-resistant surface. A 5 minute plating time at 4 amperes load has been found to be satisfactory.

In this manner, a light weight, conductively coated, plastic microwave feed horn can be easily manufactured at very low cost. Extremely close dimensional tolerances can be maintained with good electrical qualities. The plastic feed horns are only 1/6 as heavy as comparable metal feed horns.

While specific embodiments of the invention have been illustrated and described, it is to be understood that these are provided by way of example only and that the scope of the invention is to be determined by the proper scope of the appended claims.

What I claim is:

1. A method of forming a plastic microwave feed horn comprising the steps of:

pouring a room temperature curing epoxy plastic into a base feed horn to form a pattern having the interior dimensions of the base feed horn;

machining an aluminum mandrel to the dimensions of the plastic pattern;

forming a tool steel mold apparatus around the machined aluminum mandrel, said mold apparatus including right and left side molds disposed between top and bottom plates to define a mold cavity around said aluminum mandrel;

injection molding a thermoplastic into said mold cavity to form a plastic microwave feed horn around said aluminum mandrel;

removing the molded plastic microwave feed horn from the mold assembly;

removing the aluminum mandrel from the molded plastic microwave feed horn;

wet vapor honing the molded plastic microwave feed horn to sensitize the feed horn for plating;

electroless copper plating the molded plastic feed horn;

electrolytic copper plating the electroless copper plated feed horn; and gold plating the copper plated feed horn.

* * * * *